US008205937B2

(12) United States Patent
Rivera, Jr. et al.

(10) Patent No.: US 8,205,937 B2
(45) Date of Patent: Jun. 26, 2012

(54) MOBILE FOLDING TABLE WITH HIGH-SPEED CYLINDER LIFT-ASSIST AND STABILIZER MECHANISM

(75) Inventors: Jeremias C. Rivera, Jr., Elmhurst, IL (US); Doss Samikkannu, Des Plaines, IL (US); Gregory Hanusiak, Chicago, IL (US)

(73) Assignee: AmTab Manufacturing Corporation, Aurora, IL (US)

( * ) Notice: Subject to any disclaimer, the term of this patent is extended or adjusted under 35 U.S.C. 154(b) by 229 days.

(21) Appl. No.: 12/455,204

(22) Filed: May 29, 2009

(65) Prior Publication Data

US 2010/0301641 A1 Dec. 2, 2010

(51) Int. Cl.
*A47B 3/083* (2006.01)
*A47B 3/14* (2006.01)

(52) U.S. Cl. ..... 297/158.4; 108/169

(58) Field of Classification Search ..... 297/158.4; 108/129, 130, 167, 169
See application file for complete search history.

(56) References Cited

U.S. PATENT DOCUMENTS

| | | | |
|---|---|---|---|
| 2,721,778 | A | 2/1953 | Wilson |
| 2,747,958 | A | 5/1956 | Wilson |
| 2,764,460 | A | 9/1956 | Nelson |
| 2,766,089 | A | 10/1956 | Nielsen |
| 2,777,742 | A | 1/1957 | Schieber |
| 2,831,740 | A | 4/1958 | Schieber |
| 2,831,741 | A | 4/1958 | Wilson |
| 2,873,157 | A | 2/1959 | Wilson |
| 2,879,120 | A | 3/1959 | Howe |
| 2,901,304 | A | 8/1959 | Fihe |
| 3,080,833 | A | 3/1963 | Risdall |
| 3,080,834 | A | 3/1963 | Risdall |
| 3,101,062 | A | 8/1963 | Kanzelberger |
| 3,140,674 | A | 7/1964 | Cisler |
| 3,143,982 | A | 8/1964 | Blink et al. |
| 3,212,463 | A | 10/1965 | Anderson et al. |
| 3,245,363 | A | 4/1966 | Amthor, Jr. et al. |
| 3,276,401 | A | 10/1966 | Wilson et al. |
| 3,476,061 | A | 11/1969 | Takahashi |
| 3,799,073 | A | 3/1974 | Nielsen |
| 3,884,160 | A | 5/1975 | Gutierrez |
| 4,027,600 | A | 6/1977 | Mueller |
| 4,054,096 | A | 10/1977 | Wilson et al. |
| 4,223,945 | A | 9/1980 | Nikitis |
| 4,489,661 | A | 12/1984 | Fitzgerald |
| 4,596,196 | A | 6/1986 | Gunter et al. |

(Continued)

OTHER PUBLICATIONS

AmTab Manufaturing Corporation, catalog pp. 1 and 2, dated Dec. 2007, Aurora, IL.

*Primary Examiner* — Anthony D Barfield
(74) *Attorney, Agent, or Firm* — Ryndak & Suri, LLP

(57) ABSTRACT

The present invention provides a mobile folding table with attached seating having an improved lift-assist mechanism. In particular, the table includes a gas cylinder that provides a force tending to extend the cylinder to assist in folding the table into a storage position, the cylinder providing substantially no force to resist rapid extension thereof. Preferably, a mobile folding table according to the present invention also includes a stabilizing mechanism including center bench legs attached to a center leg structure that is maintained substantially upright whether the table is in an unfolded use configuration, in a mobile folded storage configuration, or in the process of being folded or unfolded. In this manner, the attached benches are prevented from freely tipping when the table is being folded or moved.

3 Claims, 6 Drawing Sheets

U.S. PATENT DOCUMENTS 4,819,569 A 4/1989 Bastian et al.
4,826,244 A 5/1989 Choi
4,932,333 A * 6/1990 Jensen et al. ..... 297/158.4 X
5,029,938 A 7/1991 Song
5,080,024 A 1/1992 Yamamoto
6,644,221 B2 11/2003 Griepentog
6,981,440 B2 1/2006 Hoshi
7,171,911 B1 2/2007 Rivera, Jr. et al.

* cited by examiner

MOBILE FOLDING TABLE WITH HIGH-SPEED CYLINDER LIFT-ASSIST AND STABILIZER MECHANISM

FIELD OF THE INVENTION

The present invention relates to mobile folding tables. More particularly, it relates to mobile folding tables with attached seating having lift-assist and stabilizer mechanisms.

BACKGROUND OF THE INVENTION

Mobile folding tables with attached seating are useful in school cafeterias and other institutional settings, as they have the potential to be versatile and allow for fast setup and removal, as well as being compact when folded for convenient storage. However, existing folding tables typically have heavy table tops and are therefore difficult to lift from an unfolded, use position to a folded storage position. Moreover, in existing folding tables with attached bench seating, the benches tend to be unstable and may freely tilt from side to side when in the folded position, thus creating an awkward and potentially unsafe condition.

A need therefore exists for a mobile folding table with attached bench seating that is both stable when folded and easy to open and close.

BRIEF SUMMARY OF THE INVENTION

In accordance with one aspect of the present invention, a mobile folding table is provided with an improved mechanism for assisted transition between an open position and a closed position. The table includes a first table section hingedly connected to a second table section to permit folding and unfolding the table about a substantially horizontal hinge axis between an open position and a closed position, wherein said first and second table sections are substantially horizontal in the open position, and wherein said first and second table sections are substantially vertical in the closed position. Assistance in lifting the table into a folded storage position is provided by a high-speed cylinder assembly having a piston and a cylinder slidably connected to the piston for movement of the piston and cylinder between fully contracted and fully extended positions. The cylinder assembly is oriented vertically so that one of the piston and cylinder is a top member, and the other is a bottom member.

In one embodiment, the top member of the high-speed cylinder assembly has a top end attached to the table proximate to the hinge axis. A linkage assembly is provided including a first side link having a top end rotatably connected to the first table section about a first side axis substantially parallel to the hinge axis, a second side link having a top end rotatably connected to the second table section about a second side axis substantially parallel to the hinge axis, and a base fixedly connected to a bottom end of the bottom member of the cylinder assembly, wherein the first and second side links each have a bottom end rotatably connected to the base about a bottom axis substantially parallel to the hinge axis, and wherein the base is located substantially vertically below the hinge axis. The cylinder assembly contains compressed fluid adapted to produce a force tending to move its members apart from each other to extend the assembly toward the fully extended position, and extending the assembly causes the table sections to fold together toward the closed position. Unlike typical cylinder assemblies employed in mobile folding tables, the cylinder assembly of the invention produces substantially no force to oppose rapid extension of the assembly, thus making the table of the invention easier to open.

In another embodiment, a table according to the invention comprises a first bench and a first bench leg, the first bench being configured for rotational movement to remain generally parallel to the first table section as the table is folded between the open and closed positions, the first bench being hingedly and slidably connected to a top end of the first bench leg. To maintain stability of the first bench when the table is being folded or moved, a bottom end of the first bench leg is fixedly attached to the base. In this manner, the first bench leg is kept substantially upright at all times, and the first bench is prevented from tipping from side to side. Preferably, the table further comprises a second bench and a second bench leg, the second bench being configured for rotational movement to remain generally parallel to the second table section as the table is folded between the open and closed positions, the second bench being hingedly and slidably connected to a top end of the second bench leg. A bottom end of the second bench leg is also fixedly attached to the base, to stabilize the second bench in a manner similar to the first bench. More benches and bench legs stabilized in a similar manner may also be included. For example, in the illustrated embodiment, two benches are provided alongside each table top half, each bench being supported by a center bench leg fixedly attached to the base and hingedly and slidably attached to the bench.

DETAILED DESCRIPTION OF THE INVENTION

A mobile folding table that is stable in the folded position and easy to open and close is described in this section.

Figure 1:
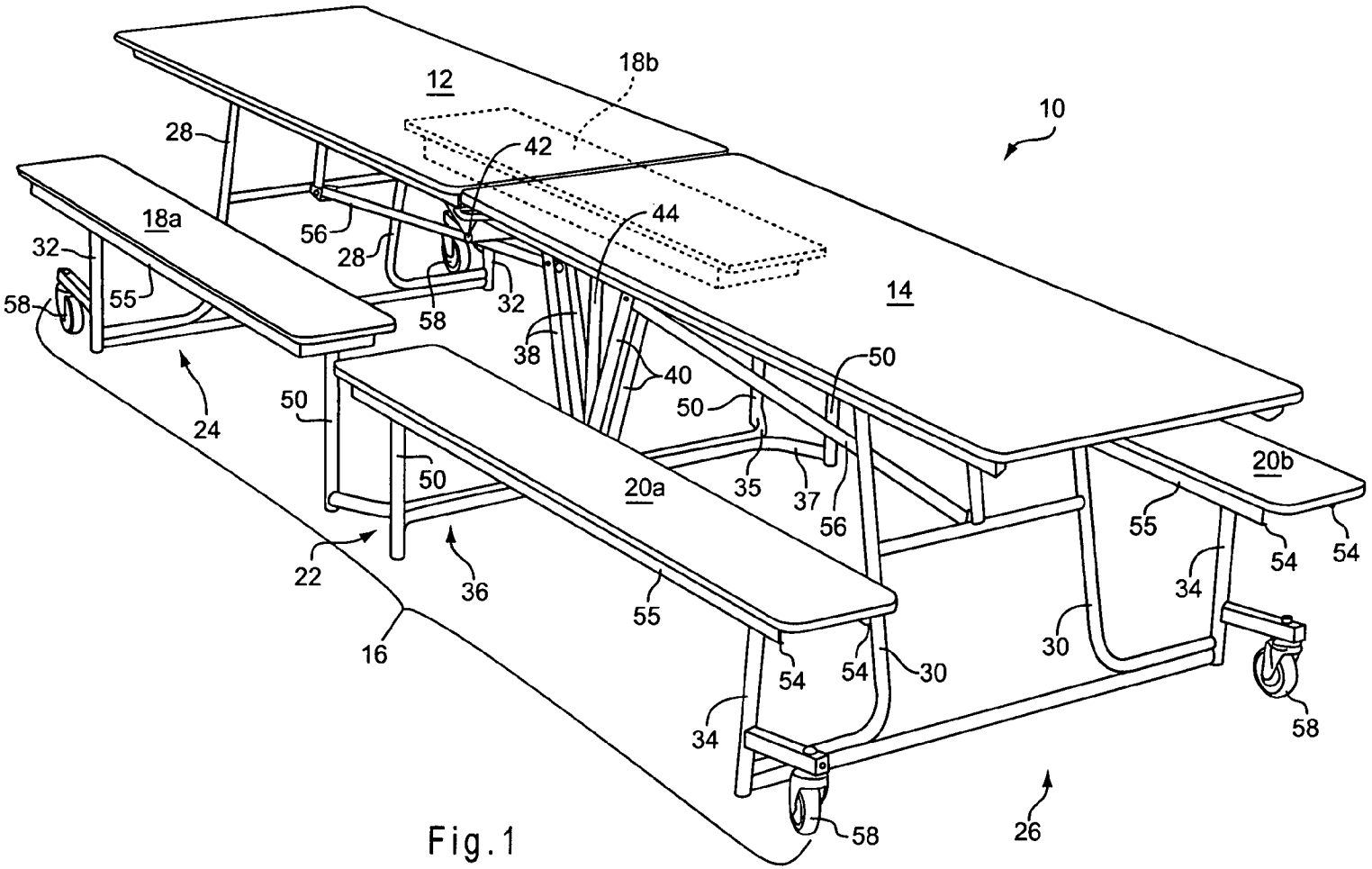
FIG. 1 is a perspective view of a mobile folding table according to the invention, shown in an unfolded configuration for use.
Figure 2:
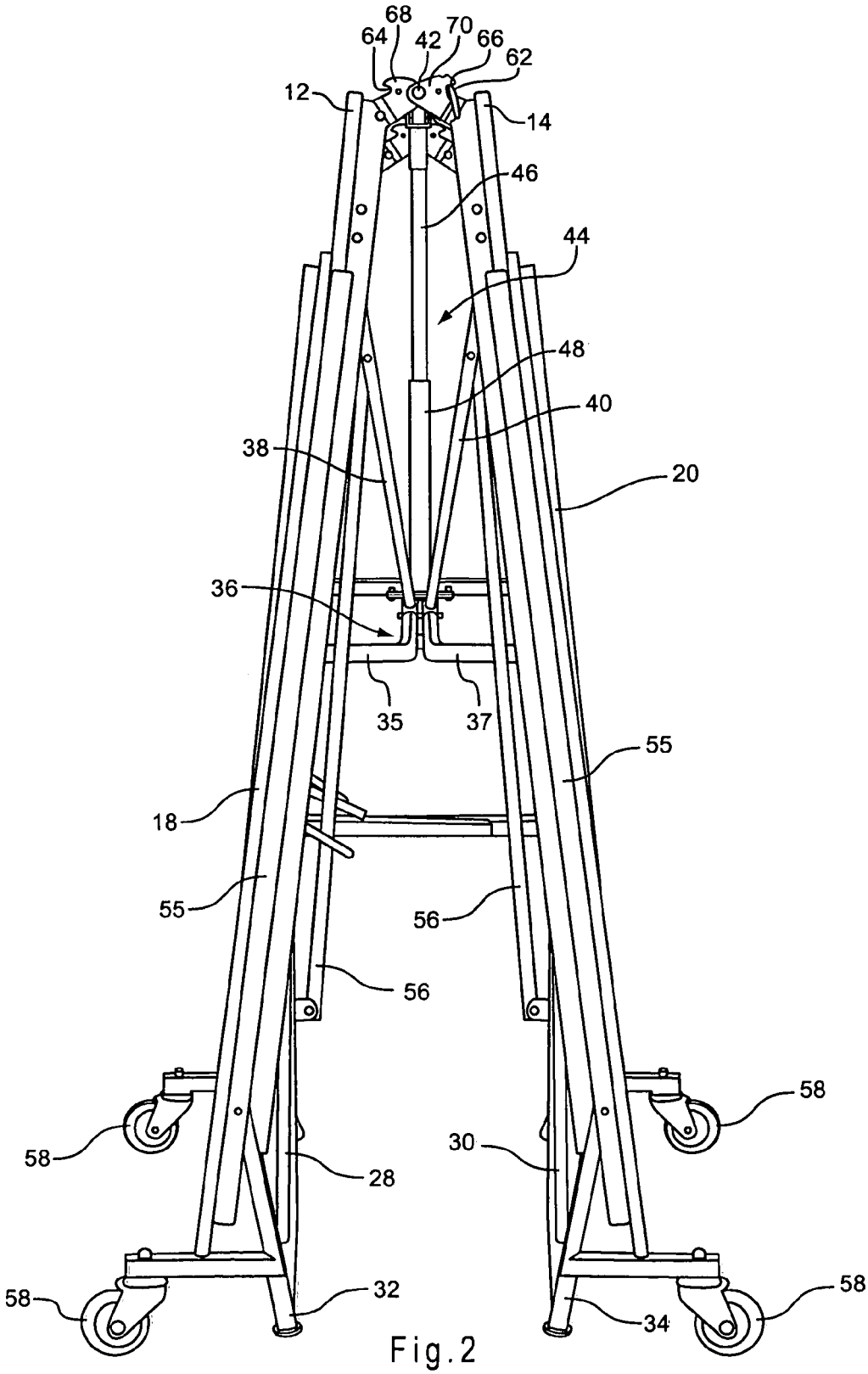
FIG. 2 is a side perspective view of the table of FIG. 1, shown in a folded configuration.

With reference to FIG. 1, a mobile folding table 10 according to the invention is illustrated in its unfolded use configuration. Table 10 includes hingedly connected table top halves 12 and 14, a frame 16, and benches 18 and 20. Table 10 is supported by frame 16, whose center portion 22 and end portions 24 and 26 also include the folding linkage permitting table 10 to be folded into the storage position as illustrated in FIG. 2.

Figure 3:
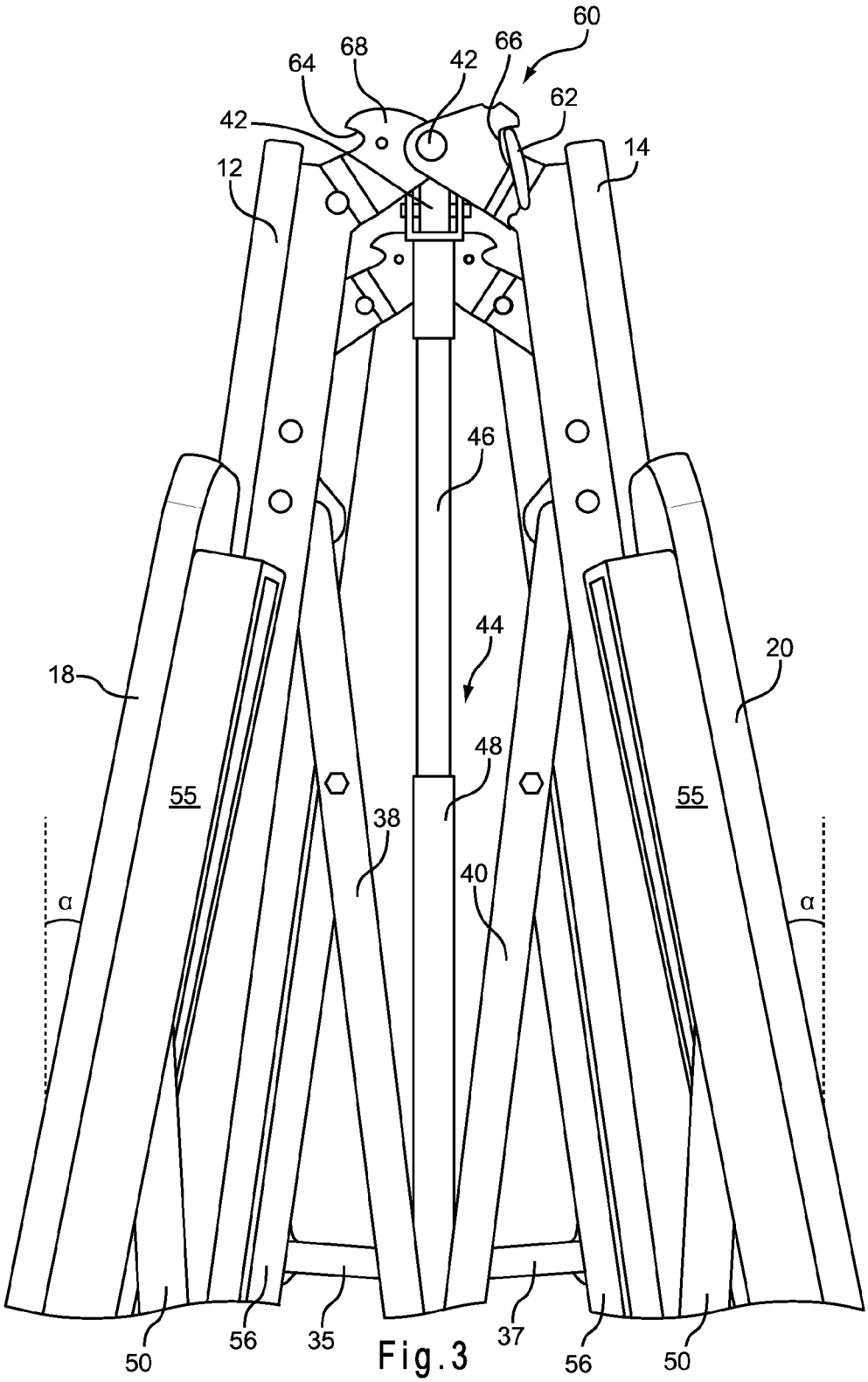
FIG. 3 is a side perspective view of a center portion of the table of FIG. 1.
Figure 4:
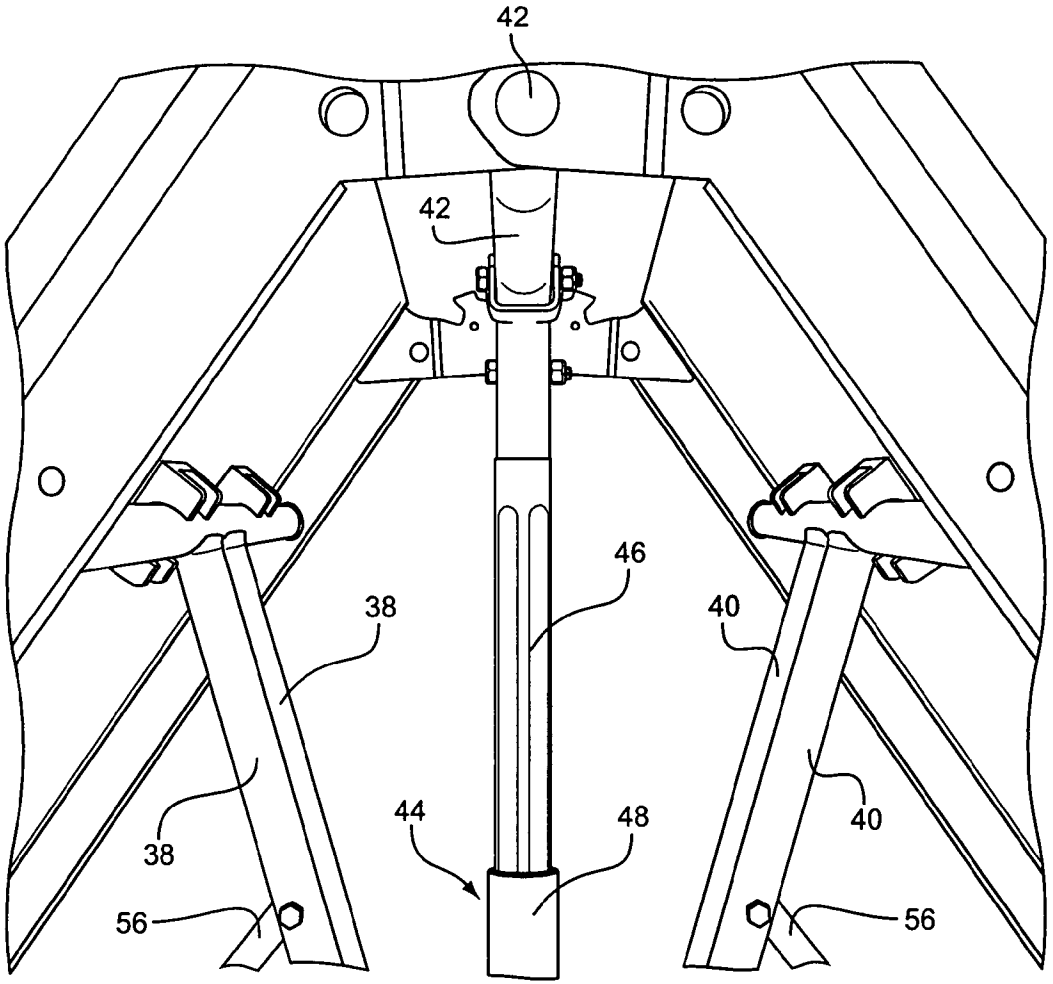
FIG. 4 is a side-bottom perspective view of a center portion of the table of FIG. 1.

The linkages and mechanics enabling table 10 to be folded will now be described, with reference to FIGS. 2-4. In particular, frame end portions 24 and 26 include table end leg portions 28 and 30 hingedly connected to table top halves 12 and 14, respectively, and bench end leg portions 32 and 34 hingedly connected to benches 18 and 20, respectively. Center portion 22 includes a center leg structure 36, side links 38 and 40 hingedly connected to center leg structure 36, as best seen in FIG. 2, and to table top halves 12 and 14, respectively, as best seen in FIG. 4. To prevent center leg structure 36 from twisting with respect to a table top center bar 42 that hingedly connects table top halves 12 and 14, center leg structure 36 is linked to center bar 42 by a vertical tube-within-tube telescoping assembly 44 including an upper tube 46 attached to center bar 42 so as to substantially prevent pivoting of assembly 44 about the axis of center bar 42, as shown in FIG. 4, and slidingly connected to a lower tube 48, lower tube 48 being fixedly attached to center leg structure 36.

Figure 5:
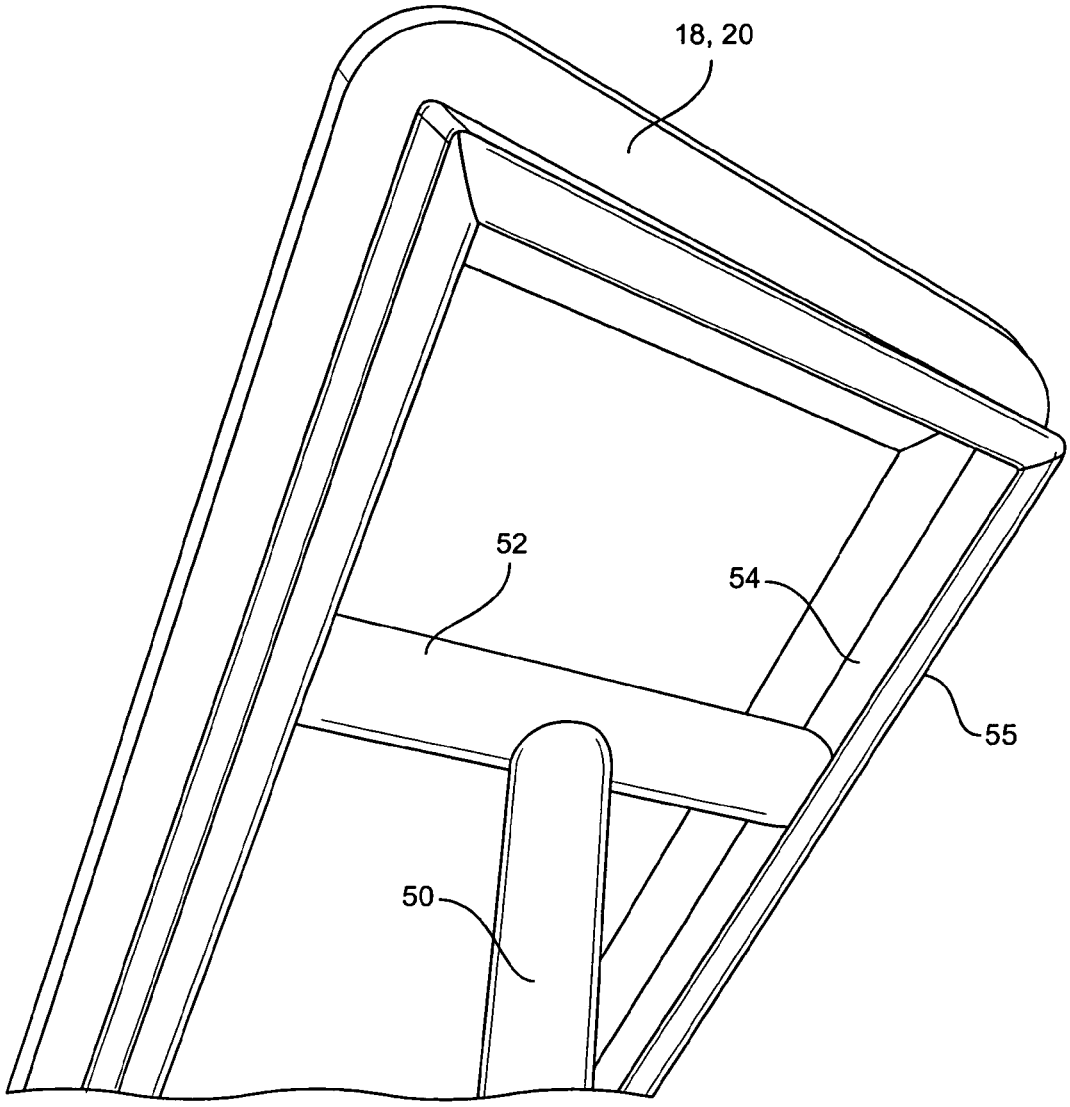
FIG. 5 is a bottom perspective view of a central end portion of a bench of the table of FIG. 1.
Figure 6:
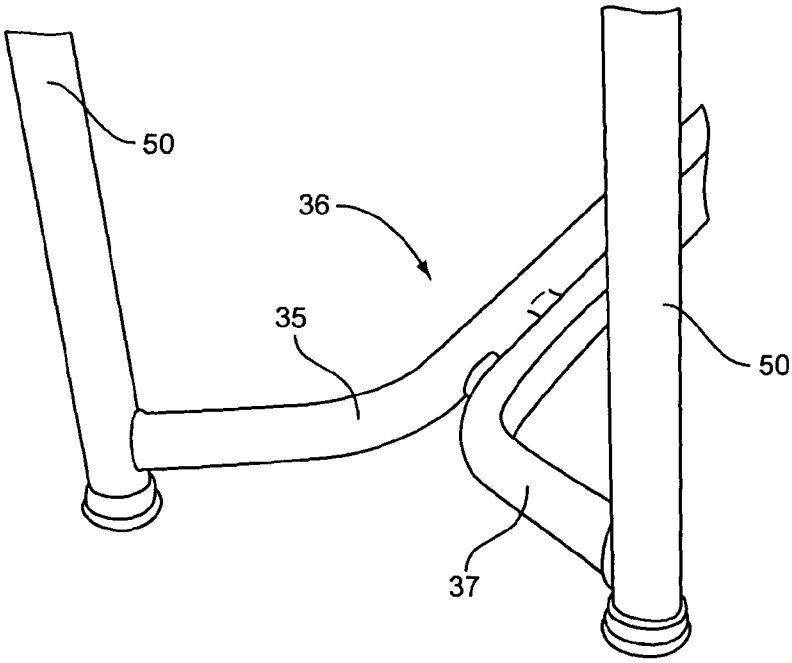
FIG. 6 is a fragmentary view of a portion of two center bench legs of the table of FIG. 1.

In this manner, four center bench legs 50, which are fixedly attached to center leg structure 36 as shown in FIGS. 1 and 6, are maintained in a substantially upright position whether table 10 is in the unfolded use configuration, in the folded storage configuration, or in the process of being folded or unfolded. One possible configuration of center leg structure 36 is that illustrated in FIG. 6, composed of bent tubes 35 and 37 welded together, although other configurations of center leg structure 36 are also possible within the scope of the invention, including, for example, a center leg structure composed of two halves securely fastened together or formed as a single unitary member. Center bench legs 50 are slidingly and pivotally connected to respective benches 18*a* & *b* and 20*a* & *b* by a horizontal cross piece 52 at the top of each bench leg 50, which slidingly and pivotally fits into underside channels 54 defined by underside aprons 55 of each of benches 18 and benches 20, as best illustrated in FIG. 5. Due to center bench legs 50 being kept upright and level at all times, benches 18 and 20 are constrained to mirror each other's folded angle $\alpha$ as shown in FIG. 3, rather than being free to tilt from side to side, which could create an awkward and potentially unsafe storage condition. Finally, frame 16 includes drive links 56 *a* & *b* pivotally connected between side links 38 and 40, respectively, and to end portions 24 and 26, respectively, so as to constrain end portions 24 and 26 to rotate inward slightly during folding, thereby coordinating the folding of end portions 24 and 26 with the folding of center portion 22 and bringing lift-off casters 58 into contact with a floor surface supporting table 10 to facilitate folding and moving table 10.

In addition to the stabilizing linkage for bench center legs 50 just described, another advantage provided by the present invention is an improved gas cylinder assembly for assisting with the lifting the center of table 10 into its folded storage position. In particular, existing folding tables typically employ gas cylinders adapted to exert both spring forces and stabilizing forces that resist rapid extension of the cylinders. Such stabilizing forces are desired in some applications, such as in opening the door of a car trunk, which might otherwise swing open dangerously quickly. However, the present inventors have found that a gas cylinder adapted to exert a spring force and substantially no force to resist rapid extension is appropriate for use in folding tables according to the invention, which are sufficiently heavy so that an additional internal force is not needed to prevent the spring force of a typical gas cylinder from folding the table at a dangerous speed. By eliminating resistance to rapid extension in the gas cylinders used, tables according to the present invention are made significantly easier to fold than tables employing typical gas cylinders of comparable capacity. Gas cylinders according to the present invention that do not resist rapid extension are conveniently termed "high-speed cylinder" assemblies.

Figure 7:
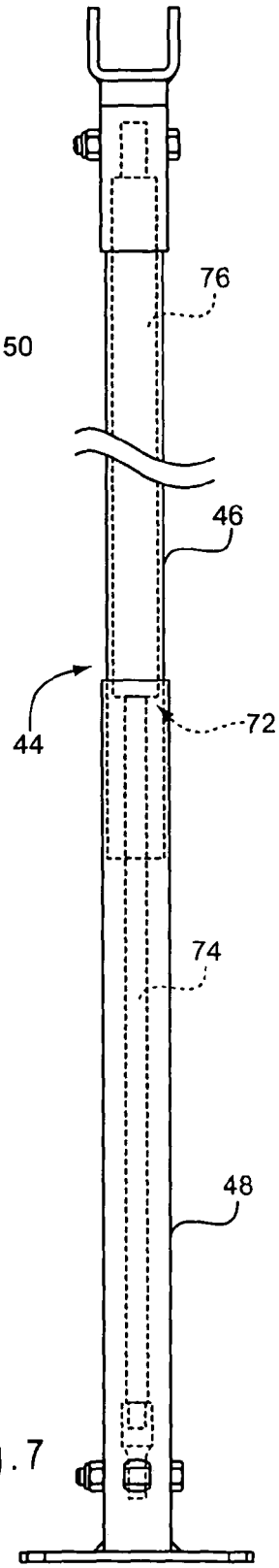
FIG. 7 is a side elevational view of a tube-within-tube telescoping assembly housing a high-speed cylinder according to the invention.

As shown in FIG. 7, a high-speed cylinder assembly 72 having a piston 74 and cylinder 76 is preferably positioned inside telescoping assembly 44 so as to urge upper tube 46 and lower tube 48 to extend apart from each other, thereby assisting in the folding of table 10. Although piston 74 is depicted as attached to lower tube 48 and cylinder 76 as attached upper tube 46, the positions of piston 74 and cylinder 76 could instead be inverted so that piston 74 is the upper member and cylinder 76 the lower member of high-speed cylinder assembly 72. It should also be noted that high-speed cylinder assemblies according to the present invention may be advantageously employed in any suitable position in a folding table linkage so as to provide a force to assist in folding a table.

Table 10 also preferably includes a suitable locking mechanism which may be engaged to lock the linkages of at least one of frame center portion 22 and frame end portions 24 and 26 when table 10 is in its unfolded use position, thus preventing undesired folding of table 10 by the lift-assisting force provided by the high-speed cylinder. In the illustrated embodiment, for example, a locking mechanism 60 includes a locking bar 62, pivotally mounted with respect to table top half 14, that may be engaged between notches 64 and 66 of hinge plates 68 and 70, respectively, to lock table 10 is in its unfolded use position. The components of locking mechanism 60 are best seen in FIGS. 2 and 3.

Additionally, it should be noted that a high-speed cylinder may be employed in conjunction with other typical means for assisting a human user in folding a table according to the invention. For example, although not shown in the figures, one or more torsion bars, springs, or other suitable force-providing mechanism associated with the end portions and/or the center portion of the table may be advantageously included.

While the invention has been described with respect to certain preferred embodiments, as will be appreciated by those skilled in the art, it is to be understood that the invention is capable of numerous changes, modifications and rearrangements, and such changes, modifications and rearrangements are intended to be covered by the following claims.

What is claimed is:

1. A mobile folding table adapted for assisted transition between an open position and a closed position, said table comprising:

a first table section pivotally connected to a second table section to permit folding and unfolding the table about a substantially horizontal pivotal axis between an open position and a closed position, wherein said first and second table sections are substantially horizontal in the open position, and wherein said first and second table sections are substantially vertical in the closed position;

a high-speed cylinder assembly having a top member and a bottom member slidably connected to the top member for movement of the members between contracted and extended positions, the top member having a top end attached to the table proximate to the pivotal axis; and a linkage assembly comprising a first side link having a top end rotatably connected to the first table section about a first side axis substantially parallel to the pivotal axis, a second side link having a top end rotatably connected to the second table section about a second side axis substantially parallel to the pivotal axis, and a base fixedly connected to a bottom end of the bottom member of the cylinder assembly, wherein the first and second side links each have a bottom end rotatably connected to the base about a bottom axis substantially parallel to the pivotal axis, and wherein the base is located substantially vertically below the pivotal axis;

wherein the cylinder assembly contains compressed fluid adapted to produce a force tending to move its members apart from each other to extend the assembly toward the extended position, wherein extending the cylinder assembly toward the extended position causes the table sections to fold together toward the closed position, and wherein the cylinder assembly produces substantially no force to oppose rapid extension of the assembly, further comprising a first bench and a first bench leg, the first bench being configured for rotational movement to remain generally parallel to the first table section as the table is folded between the open and closed positions, the first bench being pivotally and slidably connected to a top end of the first bench leg, and a bottom end of the first bench leg being fixedly attached to the base to at least substantially prevent the first bench from pivoting when the table sections are stationary.

2. The table of claim 1, further comprising a second bench and a second bench leg, the second bench being configured for rotational movement to remain generally parallel to the second table section as the table is folded between the open and closed positions, the second bench being pivotally and slidably connected to a top end of the second bench leg, and a bottom end of the second bench leg being fixedly attached to the base to at least substantially prevent the second bench from pivoting when the table sections are stationary.

3. A mobile folding table adapted for assisted transition between an open position and a closed position, said table comprising:

a first table section pivotally connected to a second table section to permit folding and unfolding the table about a substantially horizontal pivotal axis between an open position and a closed position, wherein said first and second table sections are substantially horizontal in the open position, and wherein said first and second table sections are substantially vertical in the closed position;

a high-speed cylinder assembly having a top member and a bottom member slidably connected to the top member for movement of the members between contracted and extended positions, the top member having a top end attached to the table proximate to the pivotal axis; and a linkage assembly comprising a first side link having a top end rotatably connected to the first table section about a first side axis substantially parallel to the pivotal axis, a second side link having a top end rotatably connected to the second table section about a second side axis substantially parallel to the pivotal axis, and a base fixedly connected to a bottom end of the bottom member of the cylinder assembly, wherein the first and second side links each have a bottom end rotatably connected to the base about a bottom axis substantially parallel to the pivotal axis, and wherein the base is located substantially vertically below the pivotal axis;

wherein the cylinder assembly contains compressed fluid adapted to produce a force tending to move its members apart from each other to extend the assembly toward the extended position, wherein extending the cylinder assembly toward the extended position causes the table sections to fold together toward the closed position, wherein the cylinder assembly produces substantially no force to oppose rapid extension of the assembly, and wherein the high-speed cylinder assembly is housed in a telescoping tube assembly, the telescoping tube assembly comprising an upper tube attached to the table proximate to the pivotal axis and a lower tube slidably connected to the upper tube and fixedly connected to the base.

* * * * *